US010549521B2

(12) United States Patent
Adner et al.

(10) Patent No.: US 10,549,521 B2
(45) Date of Patent: Feb. 4, 2020

(54) THERMALLY CONTROLLED PAD PRINT INK TRANSFER ARRANGEMENT

(71) Applicant: Benjamin S. Adner, Swampscott, MA (US)

(72) Inventors: Benjamin S. Adner, Swampscott, MA (US); Ian Bedford, Gloucester, MA (US); Michael E. Bissel, Beverly, MA (US); Alec J. Gronberg, Somerville, MA (US)

(73) Assignee: Benjamin S. Adner, Swampscott, MA (US)

( * ) Notice: Subject to any disclaimer, the term of this patent is extended or adjusted under 35 U.S.C. 154(b) by 53 days.

(21) Appl. No.: 15/731,178

(22) Filed: Apr. 28, 2017

(65) Prior Publication Data

US 2017/0313054 A1 Nov. 2, 2017

Related U.S. Application Data

(60) Provisional application No. 62/391,518, filed on May 2, 2016.

(51) Int. Cl.
*B41F 17/34* (2006.01)
*B41F 17/00* (2006.01)
*B41F 17/38* (2006.01)

(52) U.S. Cl.
CPC ..... *B41F 17/001* (2013.01); *B41F 17/38* (2013.01)

(58) Field of Classification Search
None
See application file for complete search history.

(56) References Cited

U.S. PATENT DOCUMENTS 4,392,905 A * 7/1983 Boyd ..... B44C 1/1712 156/235
4,511,425 A * 4/1985 Boyd ..... B65C 9/188 100/211
5,110,599 A * 5/1992 Anhauser ..... A61J 3/10 424/449
5,300,170 A * 4/1994 Donohoe ..... B44C 1/16 100/207

(Continued)

FOREIGN PATENT DOCUMENTS

GB 2193158 * 2/1988 ..... B44C 1/16
JP 58-011189 * 1/1983 ..... B41F 17/30

(Continued)

*Primary Examiner* — Leslie J Evanisko
*Assistant Examiner* — Marissa Ferguson-Samreth
(74) *Attorney, Agent, or Firm* — Don Halgren

(57) ABSTRACT

A pad printing machine is arranged for enabling the transfer and application of multiple layers of ink from an ink source both into and onto an ink receiving member. The pad printing machine comprises a depth enhanced ink well (about 0.0015 to about 0.0035 inches deep) for peripherally enclosing an absorbable pattern of ink, a vertically and horizontally displaceable temperature controlled ink transfer print pad, and a temperature controlled printable item support print fixture for supporting an ink receiving printable item member, to enable multiple layers of ink to be simultaneously transferred after pickup by the print pad as one layer, and inversely and simultaneously applied as multiple layers into and onto the ink receiving printable item member on the support print fixture.

17 Claims, 10 Drawing Sheets

(56) References Cited

U.S. PATENT DOCUMENTS

| | | | | | |
|---|---|---|---|---|---|
| 5,537,921 | A * | 7/1996 | Adner | B41F 17/001 | 101/35 |
| 5,694,839 | A * | 12/1997 | Wohl | B41F 17/001 | 101/39 |
| 9,999,573 | B2 * | 6/2018 | Cross | A61J 9/06 | |
| 2003/0136281 | A1 * | 7/2003 | Clark | B41F 17/001 | 101/41 |
| 2005/0183604 | A1 * | 8/2005 | Bruno | B41F 17/001 | 101/487 |
| 2008/0158274 | A1 * | 7/2008 | Tasaka | B41J 11/002 | 347/8 |
| 2016/0207302 | A1 * | 7/2016 | Shneider | B41F 17/00 | |

FOREIGN PATENT DOCUMENTS

| | | | | |
|---|---|---|---|---|
| JP | 06-134969 | * | 5/1994 | B41F 17/34 |
| JP | 2000009905 | * | 1/2000 | |
| JP | 2009-061662 | * | 3/2009 | B41F 17/34 |
| JP | 2011-194589 | * | 10/2011 | B41F 16/00 |
| WO | 2010106658 | * | 9/2010 | B41F 17/001 |

* cited by examiner

THERMALLY CONTROLLED PAD PRINT INK TRANSFER ARRANGEMENT

BACKGROUND OF THE INVENTION

This invention relates to ink transfer arrangements and more particularly to print pad machines for transferring images in ink from an ink source to an ink receiving surface, and is based upon Provisional Patent Application No. 62/391,518, filed 2 May 2016, incorporated herein by reference in its entirety.

Field of the Invention

This invention more particularly relates to an arrangement to generate transferrable coatings (ink deposits) for application on absorbent, non-absorbent and porous surfaces requiring decoration via the pad transfer printing process whereas more highly opaque images are required than are achievable using conventional pad transfer printing technology.

Discussion of the Prior Art

Pad transfer printing technology has been in use for many years and is a common form of printing utilized in the decoration and branding of flat and more importantly, three dimensional products. A basic patent which represents the state-of-the-art may be seen in U.S. Pat. No. 7,498,277 B2. The pad transfer printing process uses a combination of components that allow the transfer of an image from an engraved print plate (cliché) to the surface requiring decoration. These components: print plate, print pad and inks, work together in an evaporative process which allows the ink to transfer from the plate, to the print pad and finally from the print pad to the surface requiring decoration.

One prior art concept for print pad treatment includes blowing warm air on the print pad between the ink pattern pickup at the inkwell and the deposition of that ink pattern from the print pad onto the item to be printed. This blown air warmed the print pad but the inked print pad's surface temperature however, was uneven and difficult to control. This process of such blow treating of an ink laden print pad causes the evaporation of the wetted ink resulting in a single ink layer, and it also creates a non-uniformity in the disposition of the ink when the ink is applied to the printed item.

The current prior art systems are thus limited in their ability to create proper opaque images on absorbent and porous surfaces. This limitation is relative to both the maximum amount of pigment that can be contained in traditional plate etch depths and the wetted characteristics of the ink at time of transfer onto and from an inkpad.

This is best explained by understanding the theoretical capacity of the print plate to contain a volume of pigment necessary to achieve an opaque image and the result achieved when transferring wetted inks to an absorbent surface.

Pad printing inks are a mixture of resins or binders (lacking colorant), pigments (containing colorants) and solvents (lacking colorants) that comprise the ink formulation. Current art limits the maximum workable image etch depth to be in the 0.0015-0.0018 range. Depths of image etches greater than these will not support pick up and transfer of the ink by the prior art systems.

Further, wetted inks generated by current art restrictions, lack sufficient amounts of pigment to generate opaque images. In addition, these wetted ink films reconstitute themselves into a totally wet formulation at the time of transfer to the print surface resulting in absorption of the pigments and loss of opacity, in particular when printing lighter colors on darker surfaces.

It is an object of the present invention therefore, to overcome the disadvantages of the prior art.

It is a further object of the present invention to provide an ink pad transfer system which enables a multilayered or dual layered ink transfer arrangement from an etched inkwell to a printable item in a controllable manner and in a single operative step.

It is yet a further object of the present invention to provide that dual or multilayered ink to have a display layer of high opacity.

It is yet another object of the present invention to apply that dual or multilayered ink to the print item with an attachable, printable-item high-absorbency layer.

It is yet another object of the present invention to manufacture a printed item which item has a one-step multilayer ink transfer arrangement thereon.

It is still another object of the present invention to manufacture a printed item with an item-absorbable layer and a contiguous, content-different, denser, commonly applied outwardly-displayed opaque layer.

It is still another object of the present invention to manufacture a printed item with a single print-pad-delivery-motion of an item-absorbable layer and a contiguous, content-different, denser, commonly applied outwardly-displayed opaque layer.

It is still yet another object of the present invention to provide a method of manufacturing a single printed item having a multilayer ink transfer arrangement placed thereon by a single ink pad application thereagainst.

It is yet a further object of the present invention to provide a dual layer image ink transfer to an item wherein the applied dual layer images differ from one another in thermal characteristics.

It is yet a further object of the present invention to provide a dual layer image ink transfer to an item wherein the dual layer images differ from one another in opacity.

BRIEF SUMMARY OF THE INVENTION

The present invention comprises a print pad machine for the controlled transfer of layered ink from a deep well ink cliché or image to a printable item. The print pad machine includes a frame and support assembly for securing an etched image print plate and thereon. The frame support assembly includes a print fixture for supporting a printable item thereon. The frame and support assembly also includes an overhead gantry to enable the slidable moving a support housing back and forth between the image print plate and the print fixture. The support housing supports the sliding lateral displacement of an ink supply cup back and forth over the image print plate. The support housing also supports the corresponding back and forth lateral displacement of a print pad between the image on the image print plate and a printable item supported on the print fixture. The printable item may be manually placed on and removed seriatim from the print fixture, or mechanically placed and removed therefrom in a further embodiment. The support housing also permits and supports the controlled up-and-down movement of the print pad over the image and onto the image print plate, and subsequently, the up-and-down movement of the print pad against a printable item supported on the print fixture to apply a particular image thereon.

The frame support assembly also includes an enclosure for a proper system control computer for operable control of the support housing and its associated mechanisms of the print pad machine by a machine operator at a first end of the print pad machine.

The frame support assembly includes heat control modules and pad position sensors connected through a proper circuit to the system control computer within the first end of the print pad machine. In a first preferred embodiment, an articulable heat sensor is arranged on the frame support assembly adjacent the print fixture at the first end of the print pad machine. The articulable heat sensor is connected through a proper circuit to the system control computer and the heat control module for monitoring the heat of the print pad as it traverses the print pad machine from ink image pickup to ink image deposition on the printable item.

In a second preferred embodiment, the print pad has a uniform array of temperature sensors therewithin, to monitor and assist in the control and regulation of the array of heating elements within the print pad. Such temperature sensors would be connected to the system control computer which regulates the temperature of the heating elements within the print pad.

The print plate or cliché contains the etched inkwell which forms the image to be transferred to the printed item. The preferred depth of the etched inkwell image in the print plate or cliché is critically between about 0.0015 to 0.0035 inches. The etched image-bearing print plate is supported on a mounting plate and may in one embodiment have a system computer controlled arrangement for heating (or chilling) the ink therewithin. The print pad has its system computer controlled arrangement of heating elements therewithin. In another preferred embodiment, the print fixture which supports the printable item has a system computer controlled heating (or chilling) element therewithin as well. The respective heating elements within the support plate, the print pad, and the print fixture are all controlled by the system central control computer in conjunction with the heat/chilling temperature control module within the frame assembly of the print pad machine.

The articulable heat sensor embodiment and the embodiment of the implanted array of heat sensors within the print pad are controlled through a proper circuit in conjunction with the system control computer and pad position sensors to monitor and regulate those respective temperatures, particularly the temperature of the print pad so as to control and treat the thermally printed ink before and upon its deposition on an item being printed.

The articulable heat sensor tracks the movement of the laterally and vertically displaceable print pad during its transition from picking up ink on the image bearing print plate through to the deposition of ink layers upon the upwardly facing surface of the to-be printed printable item. Regulation of the temperature with respect to either the articulable heat sensor or the implanted heat sensors within the print pad, and with respect to the print fixture are critical to the development of the dual or multiple contiguous layers simultaneously deposited both in and on the structure of the printable item. The system control computer tracks the time and the temperature so as to ensure compatibility and efficacy of the specific type of ink being utilized for a particular application.

The invention thus comprises a pad printing arrangement for enabling the transfer and application of multiple layers of ink from an ink source into and onto an ink receiving member, comprising: a depth enhanced, image-constrained ink well for peripherally enclosing an absorbable pattern of ink; a vertically and horizontally displaceable temperature controlled ink transfer print pad; and a temperature controlled printable item support print fixture for supporting an ink receiving printable item member, to enable multiple layers of ink to be simultaneously transferred after pickup by the print pad as one layer, and inversely and simultaneously applied as multiple layers into and onto the ink receiving printable item member on the support print fixture.

A dual layer of ink, picked up and carried by the temperature controlled print pad to a printable item supported on the print fixture in a single step. The depth enhanced ink well has a depth of at least about 0.0015 to about 0.0035 inches. The depth enhanced ink well may be heated above ambient temperature. The temperature of the print pad and the print fixture is governed by a system control computer member. The print pad has a temperature sensor monitor either within the print pad or a sensor temperature monitor trackably following any vertical and horizontal displacement of the print pad. The temperature sensor monitor regulates the temperature of the print pad through communication with the system control computer member. The print pad carries a first layer of dense opaque ink immediately on a surface thereof and a second peripherally contiguous layer of wetted printable-item absorbable ink, for absorption in and attachment on the printable item.

The invention also comprises a process for a single step for printing multiple layers of ink from a single ink source to an ink receiving member comprising providing a pre-configured, etched enhanced depth ink source, engaging a heated print pad onto and into the temperature controlled ink source to coat the curvilinear pickup surface of the temperature controlled heated print pad with a pre-configured layer of ink, dissipating volatiles from an outer surface of the pre-configured layer of ink forming a second or wetted-surface layer of pre-configured ink and a first or dense/opaque sub-surface layer of pre-configured ink on the heated print pad during movement of the print pad from ink pick up to ink deposition, applying the sub-surface layer of pre-configured ink into the ink receiving member arranged on a printable item on the support print fixture. The process includes one or more of the following steps of simultaneously applying the first dense/opaque layer of pre-configured ink on top of the second surface of ink applied into an ink receiving printable item, heating the printable item support print fixture, monitoring the temperature of the print pad during a displacement thereof from ink pickup at an ink source to ink disposition on a printable item, controlling the temperature of the heat pad through a computer connected therewith, to maintain ink temperature and volatile displacement prior to application of the ink to a printed item, following displacement of the print pad with internal heat sensors built therewithin or an articulable temperature sensor, tracking the print pad from ink pickup to ink deposit onto a printable item, thus maintaining a uniform temperature of the ink pick-up surface print pad to a range of preferably about 230 to 270 degrees F.

The invention also includes a system for applying an enhanced opaque multi-layer applique of pre-configured ink onto a receiving surface, wherein the system effects the transition of a single layer of pre-configured ink into a multiple pre-configured layer arrangement of ink, the system may comprise: a heat controlled pre-configuration of ink engaged by a temperature controlled articulable curvilinear surfaced print pad which dissipates ink volatiles in the transition from an ink pickup location to inversely applied ink deposition location as a multiple-layer or dual layer, pre-configured ink pattern on the receiving member supported on a print fixture, wherein a print pad-outer-ink layer, which is a volatile (wetted) layer, and a print pad-dense-inner-layer inversely become respectively, the dense, opaque receiving-member outer-layer and the innermost wetted layer when they both are applied to the surface of the receiving member at a ink deposition location. The temperature of the print pad is maintained at a preferred range of about 230 to about 270 degrees F. The system may include an articulable temperature sensing monitor which follows the print pad from its ink pick up location to the print pad's ink deposition location. The system may alternatively include a print pad ink-surface sensor built into the sub surface of the curvilinear print pad. The sensing monitor arrangements provide temperature feedback to a system computer at adjust the temperature of the print pad within the desired range. The print fixture supporting an item to be printed, may also be heated by a heating arrangement therewith. The system computer controls the temperature of the print fixture within the desired range. The invention also includes a textile garment receiving material with a multiple-layer concomitantly-applied ink display pattern therewith, the multiple layer ink display pattern arranged so as to provide an opaque product indicia, the multiple-layer concomitantly-applied display pattern comprised of: a wetted layer of a pre-configured pattern of ink absorbed into the textile garment receiving material; and an opaque, concomitantly applied dense layer of ink corresponding to the pre-configured pattern of ink, overlaying the wetted layer absorbed into the textile garment receiving material. The applied multiple-layer pattern of ink is applied to the garment at a temperature of about 220 to 270 degrees F. The applied multiple-layer of ink is about 0.0022 to about 0.0030 inches thick. The textile garment as recited in claim 24, wherein the applied multiple-layer pattern of ink is applied to the garment at a temperature of about 220 to 260 degrees F. The applied multiple-layer of ink is about 0.0022 to about 0.0030 inches thick. The applied multiple-layers of ink are of different consistencies from one another. The textile garment may be supported on a heated printable item support which is heated to a temperature of about 220 to 260 degrees F. The opaque layer of ink is applied to the garment is a surface layer.

BRIEF DESCRIPTION OF THE DRAWINGS

The objects and advantages of the present invention will become more apparent, when viewed in conjunction with the following drawings, in which.

DETAILED DESCRIPTION OF THE PREFERRED EMBODIMENTS

Figure 1:
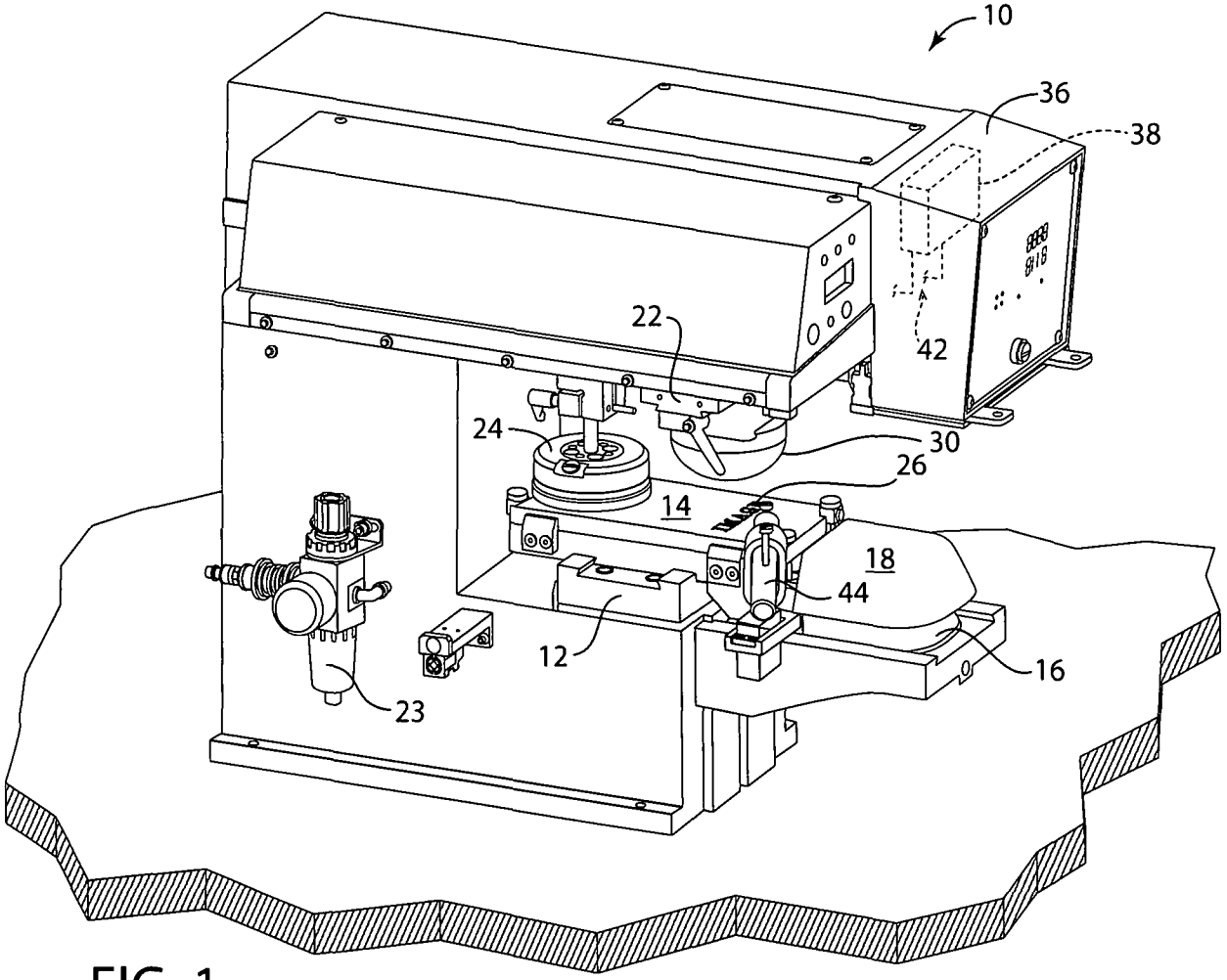
FIG. 1 is a perspective view of a print pad machine constructed according to the principles of the present invention.

Referring now to the drawings in detail and particularly to FIG. 1, there is shown the present invention which comprises a print pad machine 10 for the controlled seriatim transfer of a developing-arrangement of multi-layered ink initially drawn from a proportionately deep well ink cliché or etched image in an image print plate and then onto a printable item. The print pad machine 10 includes an elongated frame and support assembly 12 for securement and as-needed replacement of an etched ink-containing image-displaying print plate 14 thereon. The elongated frame support assembly 12 includes a print fixture 16 for fixedly supporting a preferably ink absorbing printable item 18 thereon. Such printable item 18 may be any absorbable curvilinear or linear item such as a piece of cloth or fabric as for example, an item of clothing such as a T-shirt, underwear, pants or hat, an insole or upper of a footwear member, or a sheet of material for advertising purposes or the like, represented in FIGS. 1, 7, 8 and 9C.

Figure 2:
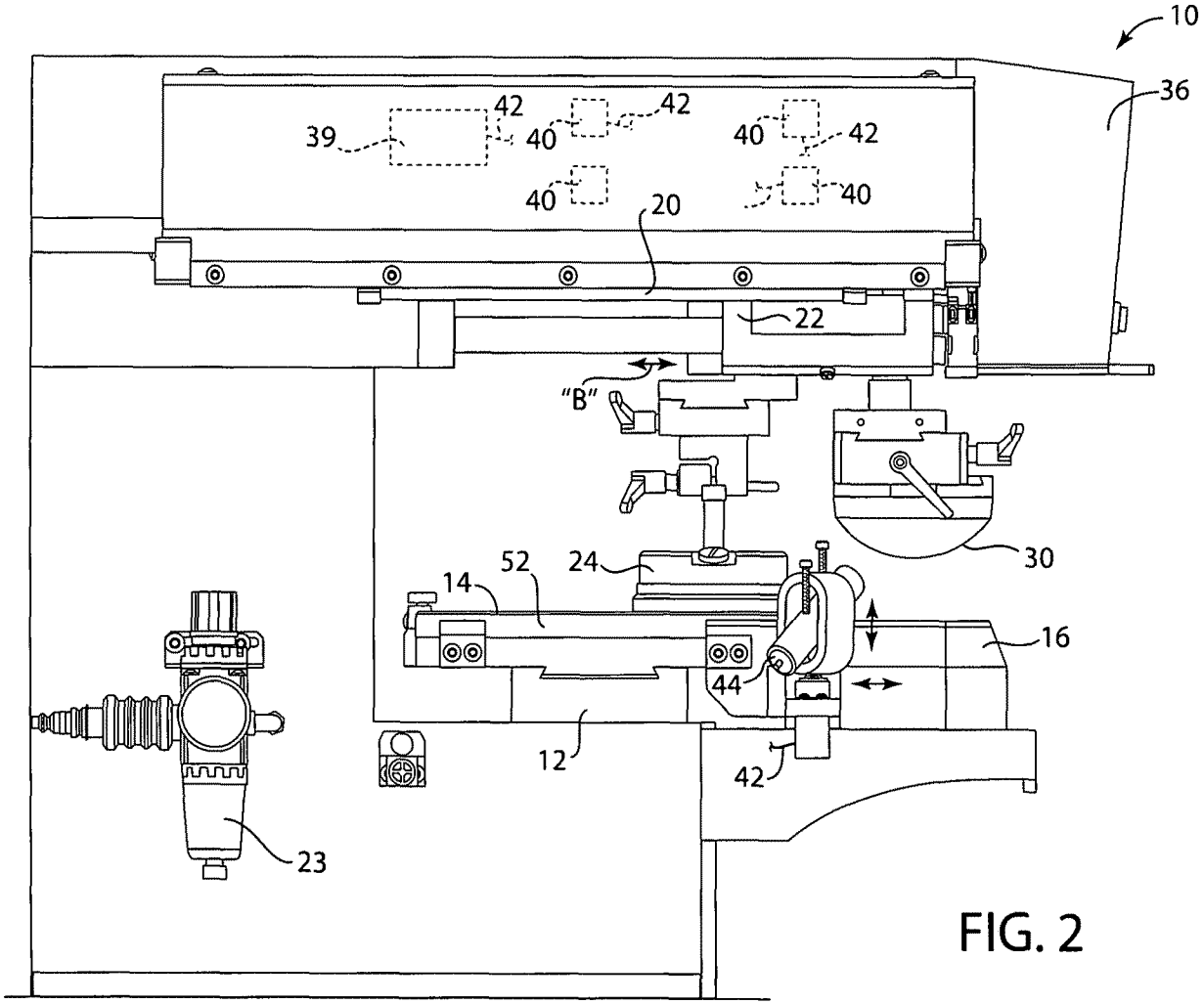
FIG. 2 is a side elevational view of the print pad machine shown in FIG. 1, with its ink cup ink supply mechanism shown slideably disposed over the image bearing print plate for deposition of a quantity of ink within the etched image thereon, with the tandem movable print pad awaiting further motion of the support housing to enable the next step in the operational sequence.
Figure 3:
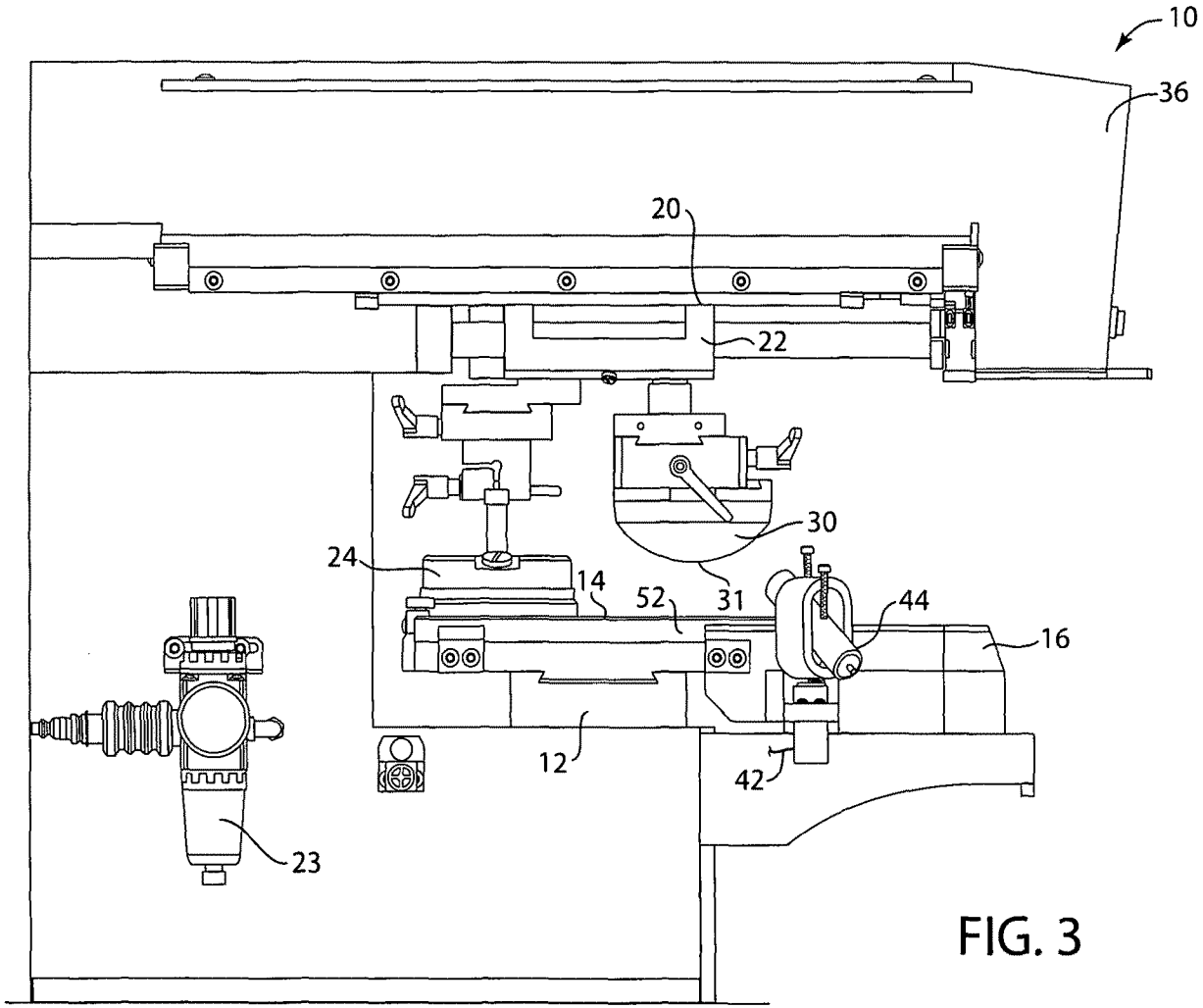
FIG. 3 is a side elevational view similar to that shown in FIG. 2 showing the ink cup ink supply mechanism slideably disposed over the rear portion of the image bearing print plate and its correspondingly moved print pad shown supported above the ink laden etched image of the print plate.
Figure 4:
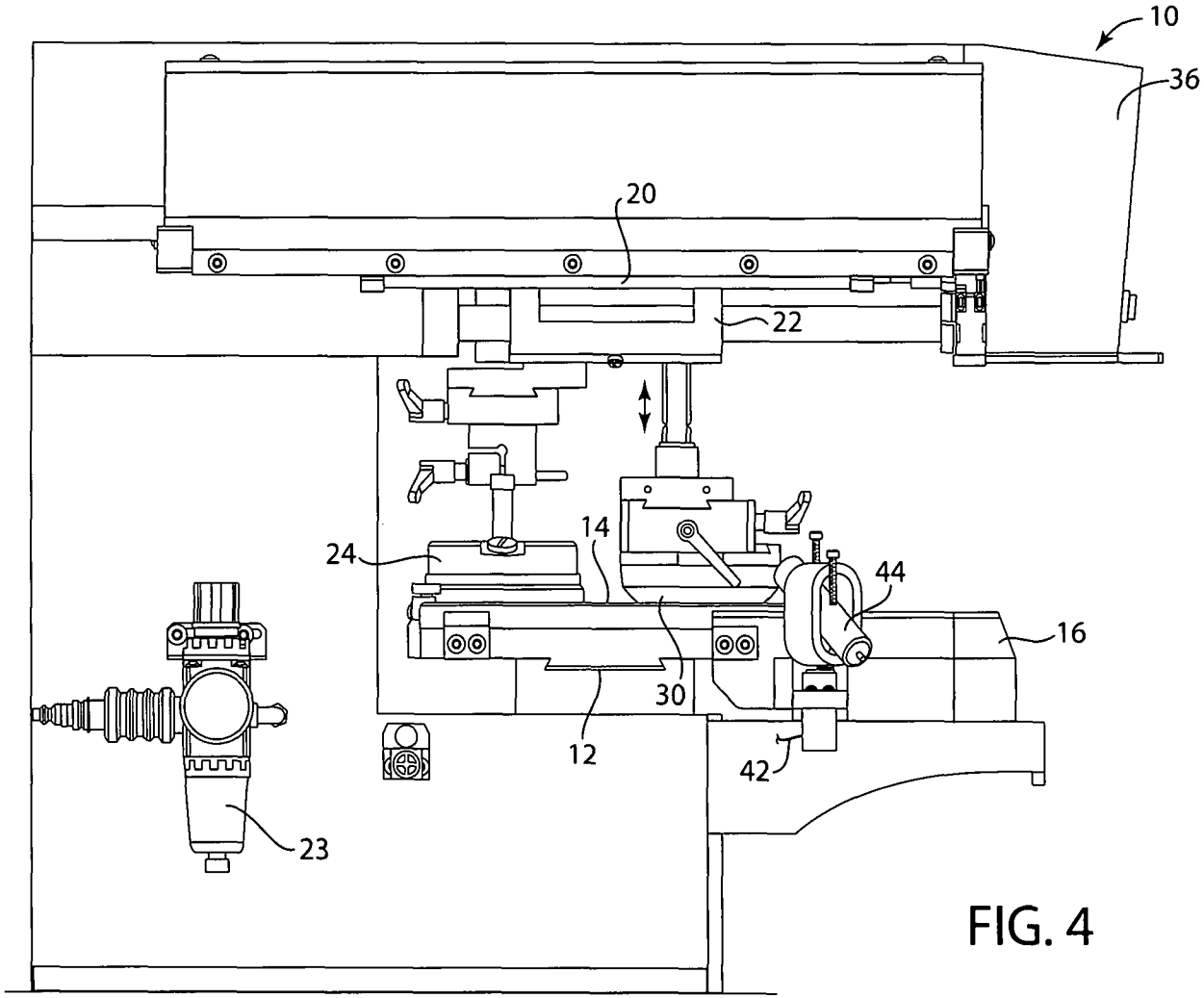
FIG. 4 is a side elevational view similar to that shown in FIG. 3, now showing the print pad displaced vertically from the support housing thereabove, to enable the print pad to pick up its quota of ink from the etched inkwell image.
Figure 5:
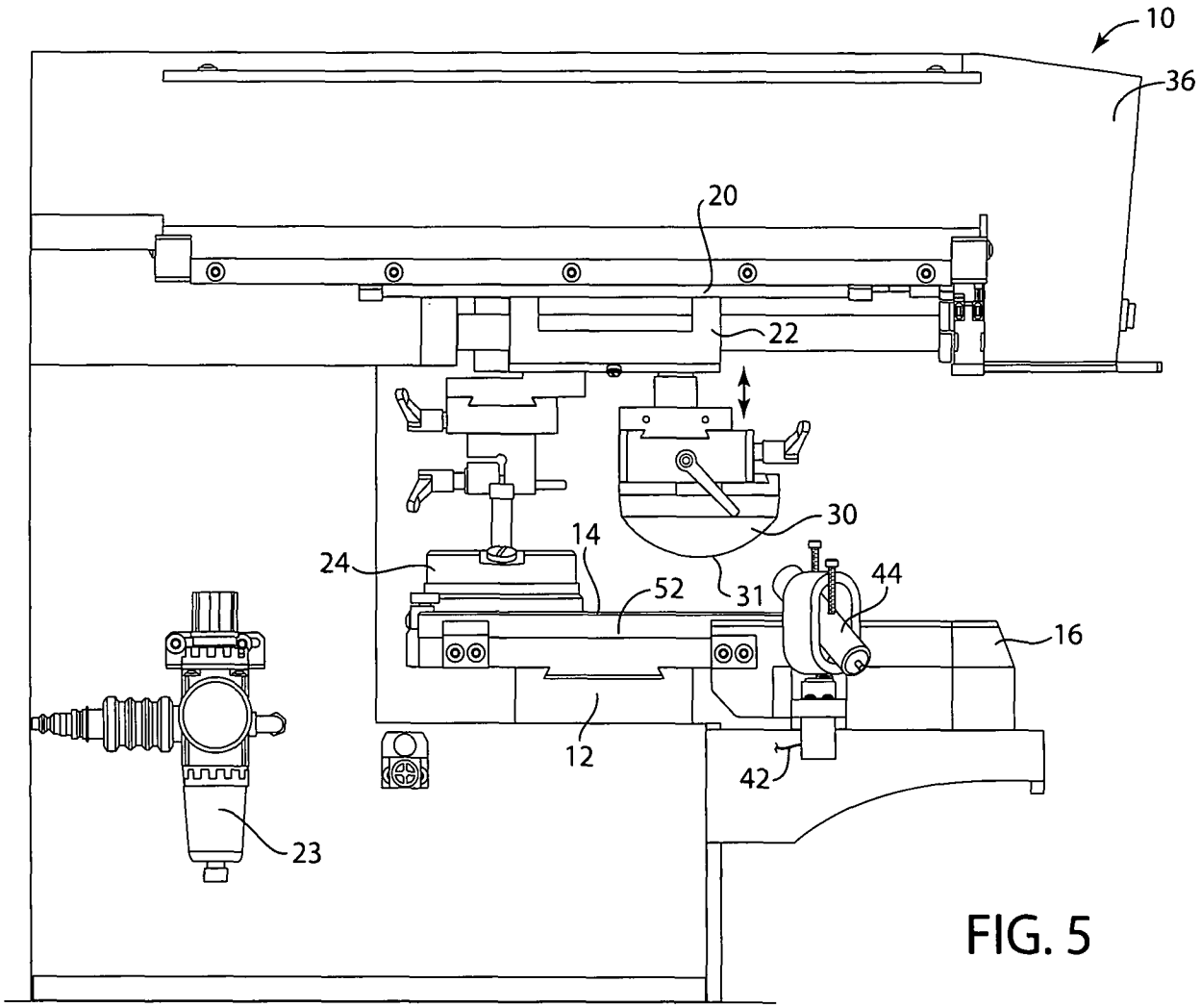
FIG. 5 is a side elevational view similar to that shown in FIG. 4, now showing the ink image laden print pad displaced vertically towards the support housing thereabove, awaiting its next transition in the operational sequence.
Figure 6:
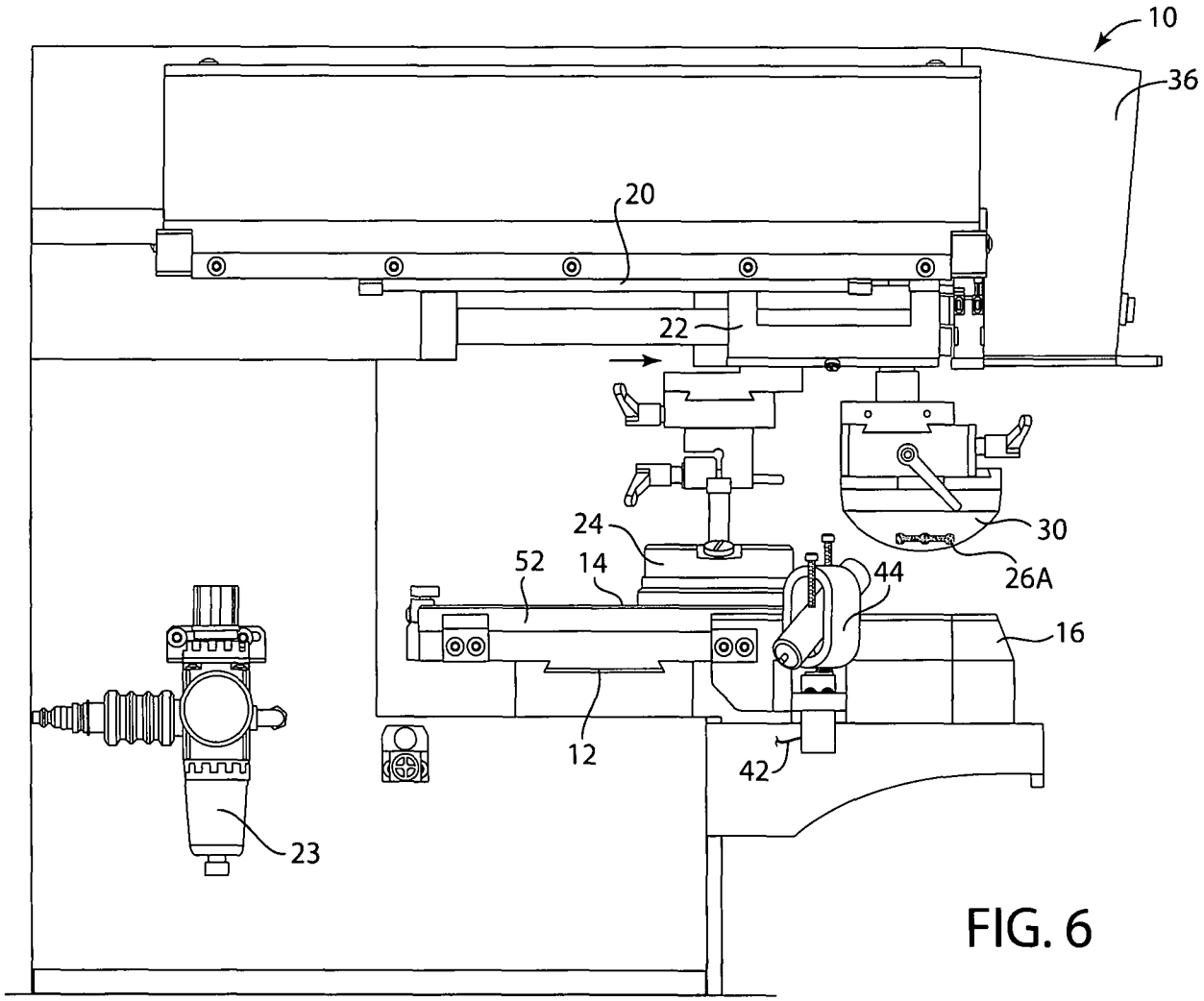
FIG. 6 is a side elevational view similar to that shown in FIG. 2, now showing the ink-image-laden print pad disposed vertically above the to be printed item supported on the print fixture at the 1$^{st}$ end of the print pad machine.

The frame and support assembly 12 also includes an overhead gantry 20, best represented in FIGS. 2-8, is utilized for slideably moving a support housing 22 back and forth between the image print plate 14 and the print fixture 16. The gantry 20 supports the pneumatically empowered longitudinal sliding of the support housing 22, through an air regulator connector arrangement 23, thereby facilitating the lateral displacement of an ink supply cup 24 back and forth, as represented by an arrow B in FIG. 2, over the cliché or etched image inkwell 26 (ink reservoir, which may be held above or below ambient temperature in a further embodiments) in the image print plate 14, as represented by the word "image" shown in FIG. 1. The support housing 22 also supports the corresponding back and forth lateral displacement of a print pad 30 between the image (inkwell) 26 on the image print plate 14 and a printable item 18 supported on the print fixture 16, as represented in FIGS. 2 and 3. The print pad 30 has a resilient, somewhat flexible, convex, downwardly-facing, curvilinearly shaped pick-up/ink deposition surface 31, as may be seen in FIGS. 3 and 5. The support housing 22 also permits and supports the controlled up-and-down movement of the print pad 30 over the etched ink-filled image 26 and onto the image print plate 14 as represented in FIGS. 4 and 5, and subsequently, the up-and-down movement, as represented by arrow "D" in FIG. 7, and pressurized application of the print pad 30 against a printable item 18 supported on the print fixture 16 to apply a particular image 26A thereon, as represented in FIGS. 6, 7, 8 and 9C.

In a further embodiment of the print pad 30 itself, which includes the convex ink receiving portion 31 being formed of a thermochromic silicon material which changes color according to the temperature of the print pad 30. For example, that convex ink receiving portion 31 of the print pad 30 may turn from a dark blue color to a beige color to visually indicate that the desired temperature of the ink bearing surface has been reached.

The frame support assembly 12 also includes an enclosure 36 for a proper system control computer 38 for operable control of the support housing 22 and its associated mechanisms of the print pad machine 10 by a machine operator (not shown), typically operating at a first end of the print pad machine 10, represented primarily in FIGS. 1 and 2.

Figure 7:
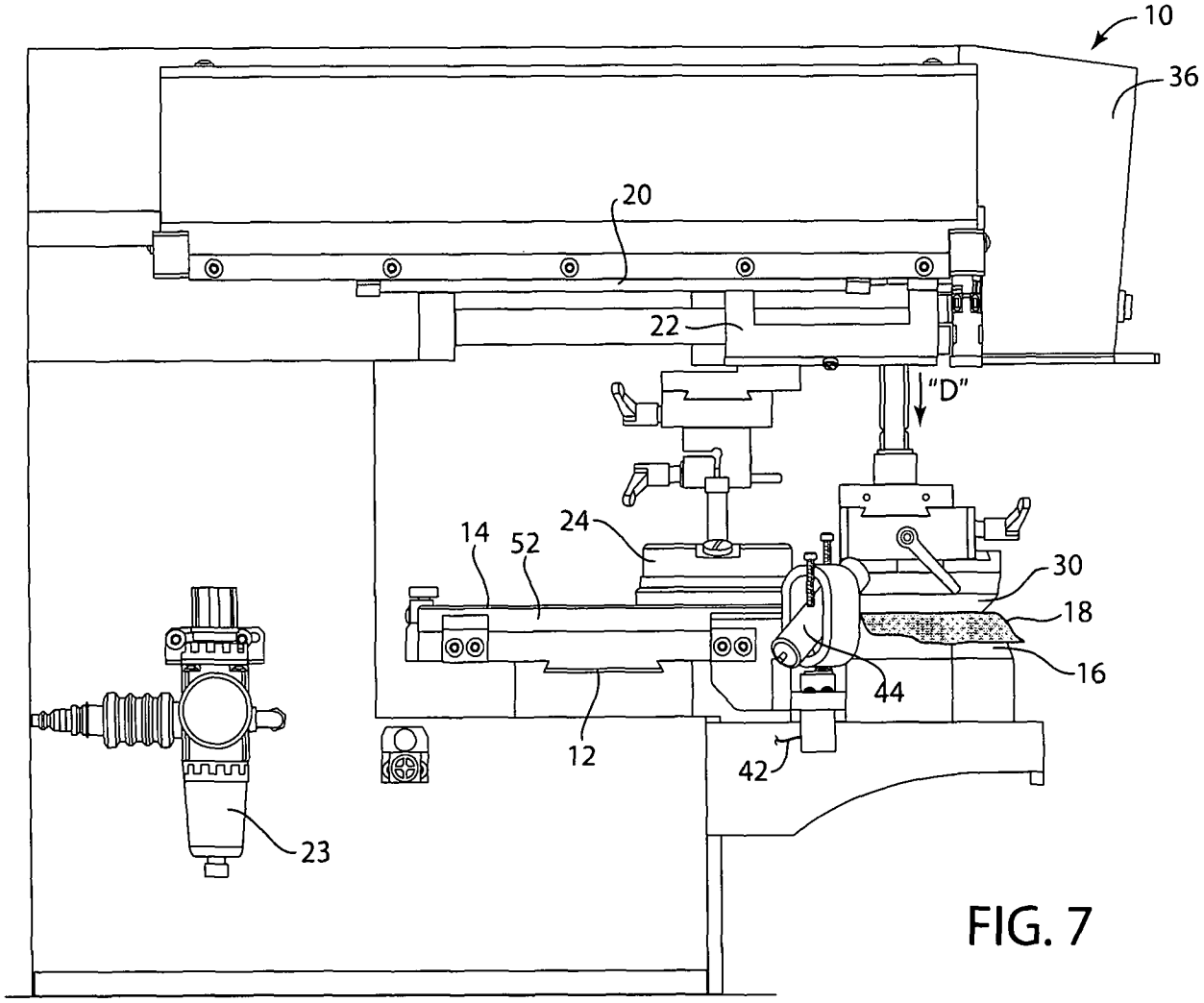
FIG. 7 is a side elevational view similar to that shown in FIG. 6, now showing the ink image laden print pad displaced downwardly from the support housing and against a printable item supported on the print fixture.
Figure 8:
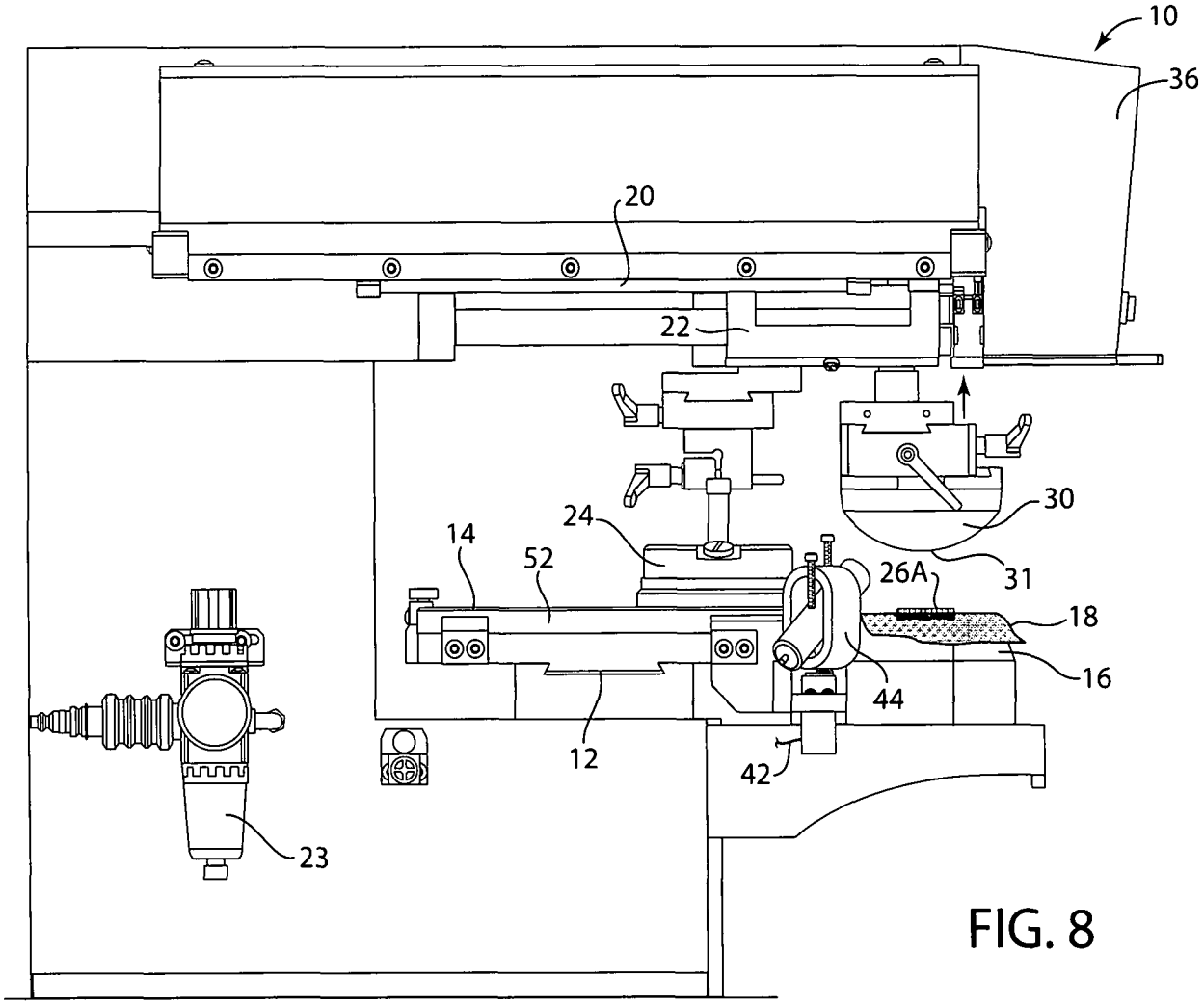
FIG. 8 is a side elevational view similar to that shown in FIG. 6, now representing an ink image free print pad displaced upwardly towards its support housing after having applied multiple layers onto the now printed item supported on the print fixture at the 1$^{st}$ end of the print pad machine.

The frame support assembly 12 includes temperature (heating or chilling) control modules 39 and pad position sensors 40 connected through a proper circuit 42 to the system control computer within the first end of the print pad machine, as shown in FIG. 2. In a first preferred embodiment, an articulable print-pad-following heat sensor 44 is arranged on the frame support assembly 22 adjacent the print fixture 16 at the first end of the print pad machine 10, as represented in FIGS. 2-8. The articulable temperature (heat or chill) sensor 44 is connected through the proper circuit 42 to the system control computer 38 and the heat control module 39, as represented in FIGS. 1 and 2, for continuously monitoring and controlling the heat of the print pad 30 as it traverses the print pad machine 10 from ink image pickup, represented in FIG. 4, to ink image deposition on the printable item, as represented in FIG. 7.

Figure 9C:
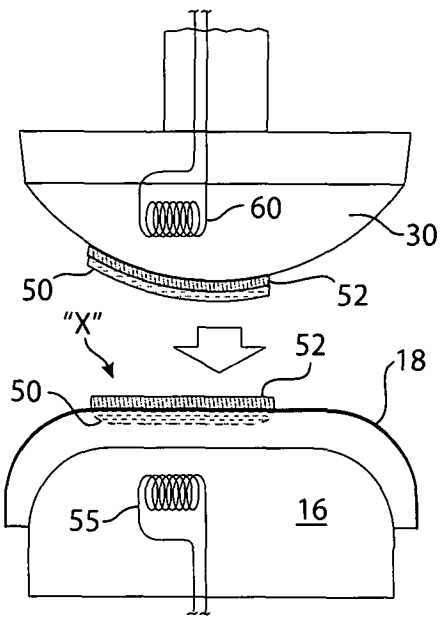
FIGS. 9A, 9B and 9C are schematic representations of the sequence of operation involved between the print pad, the ink-laden etched image on the print plate and ultimately the printable item supported on the print fixture ending as a multilayered image shown on and absorbed into the printable item.
Figure 9B:
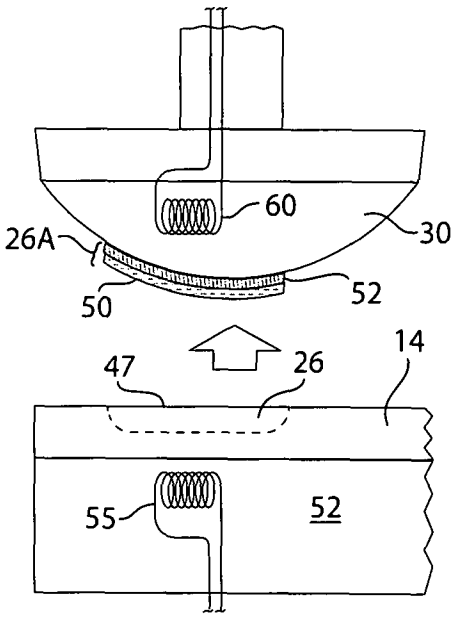
Figure 9A:
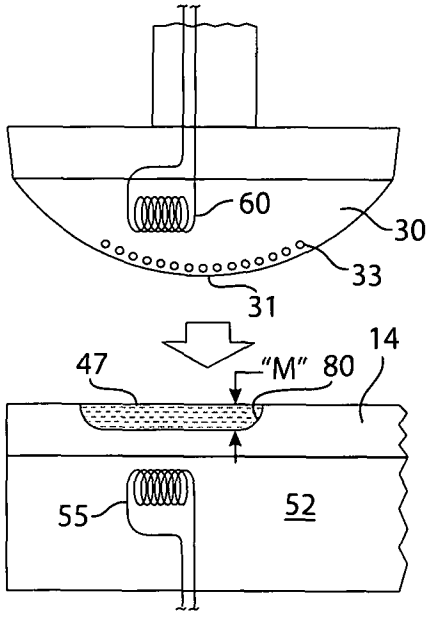

In a second preferred embodiment, the print pad 30 has a uniform array of temperature sensors 33 within the surface 31 of the print pad 30, to monitor and assist in the control and regulation of an array of heating elements 60 within the print pad 30, as represented in FIGS. 9A-9*c*. Such temperature sensors 44 or 33 would be properly connected to the system control computer 38 which regulates the temperature of the heating elements 60 within the print pad 30. Heating of the print pad 30 to required temperatures, for example, to a range of about 200 to about 350 degrees F. preferably about 230 to about 270 degrees F. depending upon the of the type of ink 47 being utilized effects the driving off of volatiles within the depth of attached ink not in direct contact with the surface 31 of the print pad 30, creating a "wetted" or second layer 50, as represented in FIG. 9B, and a more dense and more opaque, peripherally contiguous first layer 52, sandwiched between the surface of the print pad 30 again as represented in FIGS. 9B and 9*c*. When the resilient curvilinear print pad 30 is pressed against a printable item 18, the (now outer) wetted layer 50, free of certain driven-off solvents is absorbed into the printable item 18, leaving the attached contiguous (inner) first layer 52 exposed on top thereof, as a now highly visible display on the surface of the printed item 18, not in it, which dual layer with different ink consistency configuration is represented in the right hand portion "X" of FIG. 9C.

The print plate or cliché represented in FIG. 9A, contains the etched inkwell 80, shown as member 26 in a perspective view in FIG. 1, and more definitively in FIG. 9, which etched inkwell 80 forms the image 26 to be transferred by a corresponding ink now pad-attached pattern 26A, transferable to the printed item 18. The preferred depth "M" of the etched inkwell image in the print plate 14 is critically depth-enhanced to between about 0.0015 to 0.0035 inches, as represented diagrammatically in FIG. 9A. The etched inkwell 80 bearing the image to be transferred contains the ink 47, such as for example: Inkcups Now Corp. ink identified as SB Brite Series Ink. The etched image-bearing print plate 14 is supported on a mounting plate 52 and may in one preferred embodiment, have a system computer controlled heating (or chilling) element 55 therewithin, as represented in FIGS. 9A-9C. In another preferred embodiment, the print pad 14 is not heated, and the ink 47 in this embodiment, is at ambient temperature.

The print pad 30 has its system computer temperature-controlled heating element 60 therewithin, as represented in FIG. 9. The print fixture 16 which supports the printable item 18, preferably has the system computer controlled heating (or chilling) element 55 therewithin as well, again, as represented in FIGS. 9A-9C. The print pad 30 may be heated to and maintained at temperatures of about 230 to about 270 degrees F., preferably about 250 degrees F. Such temperature range varies somewhat depending on the ink being utilized, such as identified hereinabove. The respective heating elements within the support plate 52 (with that particular embodiment), the print pad 30, and the print fixture 16 are all controlled by the system central control computer 38 in conjunction with the heat control module 39 within the frame assembly 12 of the print pad machine 10 in response to the detection and monitoring of the pad 30 temperature by the articulable pad tracking heat sensor 44 or the print pad array of implanted temperature sensors 33 as represented in FIG. 9A.

The articulable heat sensor 44 embodiment and the embodiment of the inner implanted array of heat sensors 33 is within the print pad 30 is controlled through a proper circuit 42 in conjunction with the system control computer 38 and pad position sensors 40 represented in FIGS. 1 and 2, to monitor and regulate those respective temperatures, particularly the temperature of the print pad 30 so as to induce and control the thermally differentiated separate dual ink layers 50 and 52 upon their deposition into and onto the printable item 18. The thin evaporated "wetted" layer 50 being absorbed first into the item 18, and the contiguous denser layer 52 being then contiguously and simultaneously applied onto the being-printed item 18.

The articulable heat sensor 44 is controllably programmed to track the transitory movement of the laterally and vertically displaceable print pad 30 during its transition from the picking up of ink 47 from the etched image bearing print plate 14 through to the concomitant deposition of multiple ink layers 50 and 52 upon the upwardly facing surface of the to-be-printed, being printable item 18, as represented in FIG. 7. Regulation of the temperature with respect to either the articulable heat sensor 44 or to the implanted array of heat sensors 33 embedded within the print pad 30, and with respect to the print pad 30, the image bearing print plate 14 (if heat utilized there) and to the print fixture 18 are critical to the development of the dual layers 50 and 52 deposited both in and on the structure of the printable item 18. The system control computer 38 tracks the time of movement and the temperature of the print pad 30 so as to ensure compatibility and efficacy in conformance to the temperature and evaporation characteristics of the specific type of ink 47 being utilized for a particular print item application.

Figure 10:
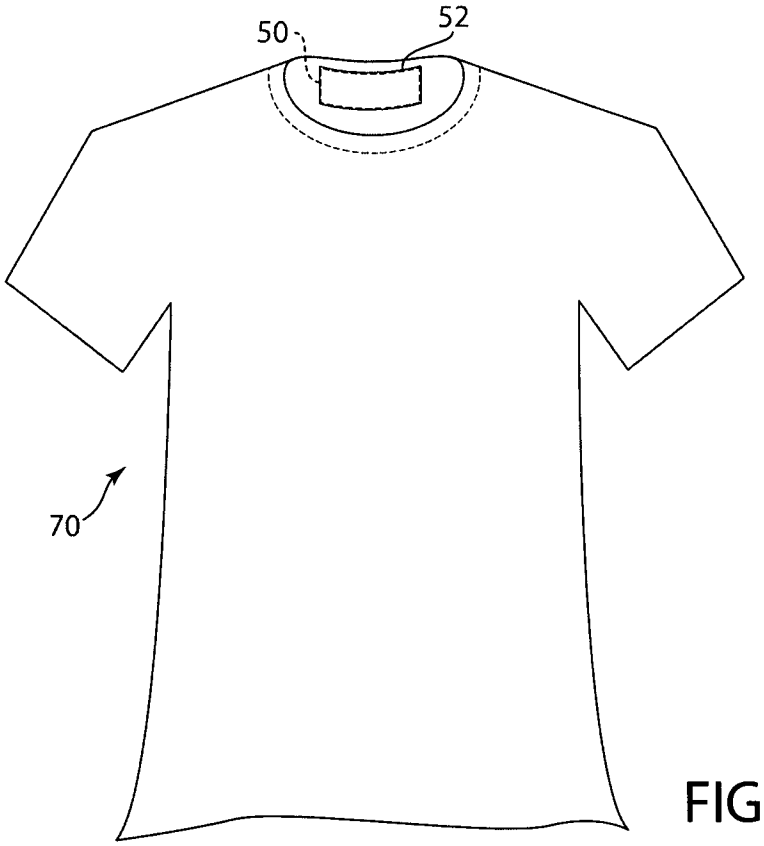
FIG. 10 shows a printed item constructed according to the principles of the present invention.

FIG. 10 shows an article of clothing 70, made by the inventive process/system as for example, a T-shirt displaying a label which has an opaque "on the surface" layer 52 and an absorbed "wetted" layer 50, similar to that identified at location "X" still on the print fixture shown in FIG. 9.

The invention claimed is:

1. A pad printing arrangement for enabling the transfer and simultaneous application of multiple layers of ink from a common ink source and as multiple layers into and onto an ink receiving member, comprising:

a depth-enhanced image source ink well for peripherally enclosing an absorbable pattern of ink, the ink well having temperature monitoring therein with a heating element and a chilling element therein for changing a temperature therein;

a vertically and horizontally displaceable temperature controlled ink transfer print pad; and a printable-item support print fixture for supporting an ink receiving printable item member, to enable dual layers of ink to be simultaneously transferred after pickup by the print pad as one layer, and inversely and simultaneously applied as multiple layers both into and onto the ink receiving printable item member on the printable-item support print fixture wherein the print pad is followed, monitored and controlled by a movably articulable print pad movement-tracking, independent, print-pad-external-temperature sensor monitor to sense and control external surface ink temperatures of the print pad to enable either heating and chilling to occur in the print pad to enable a dual ink layer deposition onto an ink receiving member.

2. The pad printing arrangement as recited in claim 1 wherein the depth enhanced image source ink well has a depth of at least about 0.0015 to about 0.0035 inches.

3. The pad printing arrangement as recited in claim 2, wherein the depth-enhanced image source ink well is temperature controlled.

4. The pad printing arrangement as recited in claim 3, wherein the depth-enhanced image source ink well is heated above ambient temperature.

5. The pad printing arrangement as recited in claim 3, wherein the depth-enhanced image source ink well is chilled below ambient temperature.

6. The pad printing arrangement as recited in claim 1 wherein the printable item support print fixture is temperature controlled.

7. The pad printing arrangement as recited in claim 1, wherein the temperature of the print pad and the printable-item support print fixture is governed by a system control computer member.

8. The pad printing arrangement as recited in claim 1, wherein the temperature sensor is an articulable temperature sensing device to monitor the external surface ink temperatures of the print pad by following any vertical and horizontal displacement thereof.

9. The pad printing arrangement as recited in claim 1, wherein the temperature sensor monitor is an array of thermocouples implanted within the print pad so as to monitor and provide feedback control for the external surface ink temperatures of the print pad.

10. The pad printing arrangement as recited in claim 7, wherein the temperature sensor monitor regulates the temperature of the print pad through communication with the system control computer member.

11. The pad printing arrangement as recited in claim 1, wherein the print pad carries a first layer of dense opaque ink immediately on a surface thereof and a second peripherally contiguous layer of wetted printable-item absorbable ink, for absorption in and attachment on the ink receiving printable item member.

12. The pad printing arrangement as recited in claim 1, wherein the print pad includes a convex ink receiving portion formed of a thermochromic silicon material which changes color according to the temperature of the print pad to visually indicate that a desired temperature of an ink bearing surface has been reached.

13. The print pad printing arrangement as recited in claim 1, wherein the print pad supported on an articulable gantry for movement forwardly and rearwardly and up-and-down from the depth enhanced image source inkwell and onto the ink receiving printable item member.

14. A pad printing arrangement for enabling the transfer and simultaneous application of multiple layers of ink from a common ink source into and onto an ink receiving member, comprising:

a depth enhanced image source inkwell for peripherally enclosing an absorbable pattern of ink; a vertically and horizontally displaceable temperature controlled ink transfer print pad; and a printable item support print fixture for supporting an ink receiving printable item member, to enable multiple layers of ink to be simultaneously transferred after pickup by the print pad as one layer and inversely and simultaneously applied as multiple layers both into and onto the ink receiving printable item member on the printable-item support print fixture wherein the print pad is independently followed, monitored and controlled by a movably-articulable print pad movement-tracking, print-pad-external-temperature sensor monitor to sense and control external surface ink temperatures of the print pad to enable temperature changes to occur in the print pad to facilitate a dual ink layer deposition onto an ink receiving member.

15. The pad printing arrangement as recited in claim 14, wherein the printable item support print fixture is heated.

16. The pad printing arrangement as recited in claim 14, wherein the printable item support print fixture is chilled.

17. The pad printing arrangement as recited in claim 14, wherein the print pad is heated between about 200 to about 350° F. to drive off volatiles of attached ink not in direct contact with a surface of the print pad to create a wetted or $2^{nd}$ layer of ink thereon.

* * * * *